US007669739B2

(12) United States Patent
Schmeisser

(10) Patent No.: US 7,669,739 B2
(45) Date of Patent: Mar. 2, 2010

(54) ROTARY STIRRING DEVICE FOR TREATING MOLTEN METAL

(75) Inventor: Dirk Schmeisser, Velen (DE)

(73) Assignee: Foseco International Limited, Staffordshire (GB)

( * ) Notice: Subject to any disclaimer, the term of this patent is extended or adjusted under 35 U.S.C. 154(b) by 1073 days.

(21) Appl. No.: 10/540,152

(22) PCT Filed: Dec. 17, 2003

(86) PCT No.: PCT/GB03/05492

§ 371 (c)(1),
(2), (4) Date: Jan. 25, 2006

(87) PCT Pub. No.: WO2004/057045

PCT Pub. Date: Jul. 8, 2004

(65) Prior Publication Data

US 2009/0071294 A1 Mar. 19, 2009

(30) Foreign Application Priority Data

Dec. 21, 2002 (GB) ..... 0229871.9

(51) Int. Cl.
*C22B 9/05* (2006.01)
*B01F 13/02* (2006.01)

(52) U.S. Cl. ..... 222/603; 266/217; 266/235; 266/239; 366/102

(58) Field of Classification Search ..... 266/235, 266/217, 239; 222/603; 366/102
See application file for complete search history.

(56) References Cited

U.S. PATENT DOCUMENTS

| | | | | |
|---|---|---|---|---|
| 3,227,547 | A | 1/1966 | Szekely | |
| 3,849,119 | A | 11/1974 | Bruno et al. | |
| 6,060,013 | A | 5/2000 | Le Brun et al. | |
| 6,960,239 | B2 * | 11/2005 | Bilodeau et al. | 75/414 |

FOREIGN PATENT DOCUMENTS

| | | |
|---|---|---|
| CA | 2 073 706 A | 1/1994 |
| EP | 0 183 402 | 6/1986 |

(Continued)

OTHER PUBLICATIONS

Patent Abstracts of Japan, vol. 1995, No. 6; Jul. 31, 1995 & JP 07 055365 A Hatachi Metals Ltd.; Mar. 3, 1995 (Abstract).

*Primary Examiner*—George Wyszomierski
*Assistant Examiner*—Tima M McGuthry-Banks
(74) *Attorney, Agent, or Firm*—Nixon & Vanderhye

(57) ABSTRACT

The invention relates to a rotary device for dispersing a gas in a molten metal. The device comprises a hollow shaft at one end of which is attached a rotor. The rotor has a roof and a base which are spaced apart and connected by a plurality of vanes. A compartment is defined between each adjacent pair of vanes and the roof and the base, and each compartment has an inlet and first and second outlets. A flow path is defined through the shaft into the inlets of the compartments and out of the first and second outlets. Each first outlet is disposed radially outwardly of the respective inlet and arranged to disperse gas laterally of the rotor in use, and each second outlet is disposed in the roof of the rotor and arranged to disperse gas upwardly from the rotor in use.

24 Claims, 9 Drawing Sheets

FOREIGN PATENT DOCUMENTS

Figure 1A:
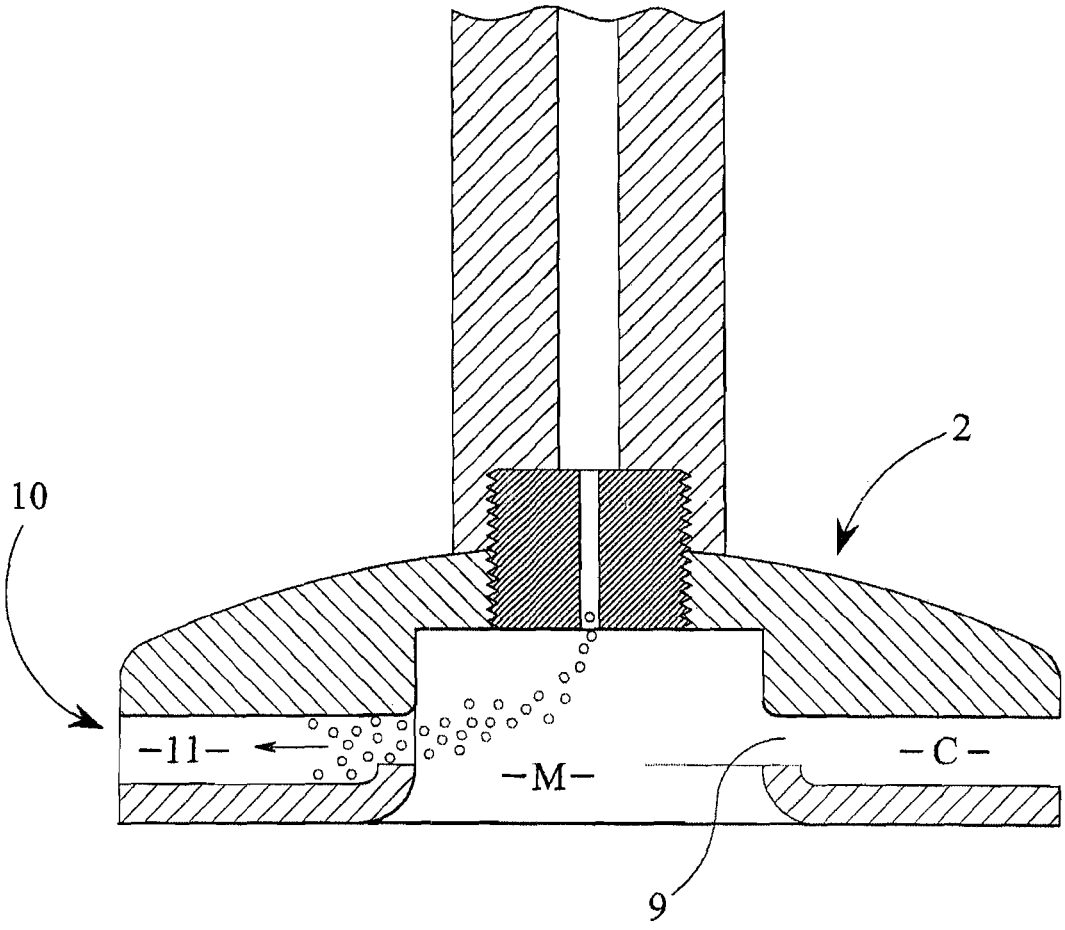
FIG 1a ( Prior Art )

| | | | |
|---|---|---|---|
| JP | 58-17823 | A | 2/1983 |
| JP | 1-259135 | A | 10/1989 |
| JP | 8-325648 | A | 12/1996 |
| WO | WO 99/34024 | A1 | 7/1999 |
| WO | WO 02/22900 | A2 | 3/2002 |

* cited by examiner

ROTARY STIRRING DEVICE FOR TREATING MOLTEN METAL

This application is the U.S. National Phase of International Application PCT/GB2003/005492, filed 17 Dec. 2003, which designated the U.S. PCT/GB2003/005492 claims priority to British Application No. 0229871.9 filed 21 Dec. 2002. The entire content of these applications are incorporated herein by reference.

The present invention relates to a rotary device for treating a molten metal.

It is well known that the presence of dissolved gas in molten metal can introduce defects in the solidified product. For example, defects are introduced in castings and wrought products manufactured from aluminium or its alloys due to porosity arising from the presence of hydrogen gas. For example, hydrogen gas diffusing to voids and discontinuities (e.g. oxide inclusions) can result in blister formation during the production of aluminium alloy plate, sheet and strip. Other defects such as porosity in castings may also be associated with the presence of hydrogen gas.

It is common practice to treat molten aluminium and its alloys to remove hydrogen and solid impurities by flushing with a gas such as chlorine, argon, nitrogen or a mixture of these gases, the process commonly being referred to as "degassing". One way of performing the degassing is to use a hollow shaft to which a rotor is attached. In use the shaft and rotor are rotated and gas is passed down the shaft and dispersed into the molten metal via the rotor. An example of such an assembly is described in EP 0332292 (the entirety of which disclosure is included herein by reference) and shown in FIG. 1*a*. The rotor 2 comprises a number of compartments C each of which has an inlet 9 and an outlet 10, adjacent compartments being separated by vanes 11. The rotor is characterised by having an open chamber M in its base and by having the outlets larger than the inlets. The rotor is connected to a hollow shaft via a tubular connection piece.

Figure 1B:
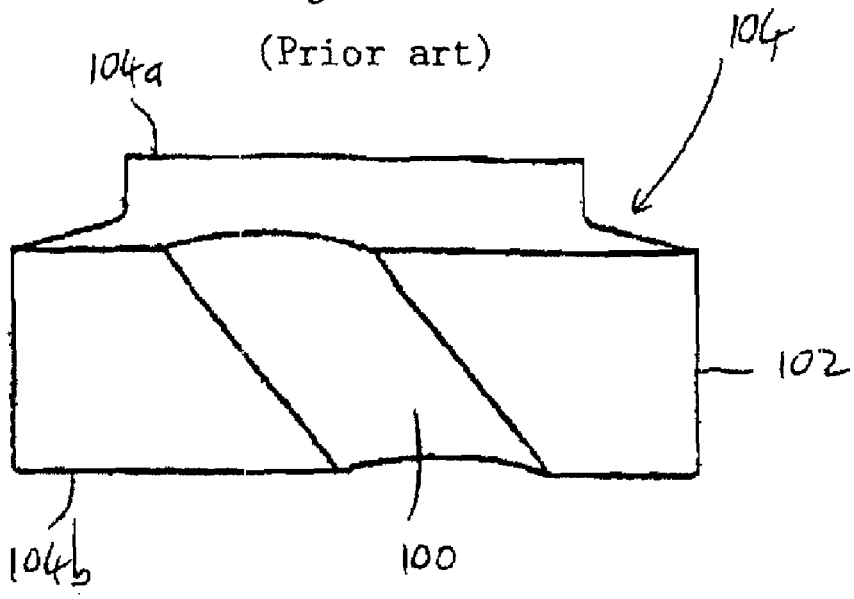
Figure 1b (Prior art)

A further prior art rotor is shown in FIG. 1*b*. In this case, a number of parallel semi-circular channels 100 or grooves are provided in the peripheral cylindrical surface 102 of the rotor 104. The channels 100 pass diagonally downwardly from the top 104*a* of the rotor 104 to its base 104*b*. In use, gas passes through a bore 106 passing vertically through the centre of the rotor 104, exiting the base 104*b* of the rotor 104 before being dispersed by the rotating rotor 104 as the gas rises.

It is an object of the present invention to provide an improved rotary device which preferably offers one or more of the following advantages over the known devices:—

(i) more rapid degassing, (ii) more efficient removal of solid impurities such as oxide inclusions, (iii) as a consequence of (i) and (ii), higher durability and therefore longer life.

According to the present invention there is provided a rotary device for dispersing a gas in a molten metal, said device comprising a hollow shaft at one end of which is a rotor, said rotor having a roof and a base, said roof and base being spaced apart and connected by a plurality of dividers, a passage being defined between each adjacent pair of dividers and the roof and the base, each passage having an inlet and first and second outlets, a flow path being defined through the shaft into the inlets of the passages and out of the first and second outlets, wherein each first outlet is disposed radially outwardly of the respective inlet and arranged to disperse gas laterally of the rotor in use, and wherein each second outlet is disposed in the roof of the rotor and arranged to disperse gas upwardly from the rotor in use.

Surprisingly, the inventors have found that the combination of laterally directed and upwardly directed outlets allows smaller and more numerous bubbles of gas to be created which results in significantly more efficient degassing and cleaning compared to the device of EP 0332292 such that the rotation speed can be reduced while maintaining the same efficiency of degassing/cleaning, thereby extending the life of the shaft and rotor, or degassing/cleaning can be achieved more efficiently at the same rotor speed, providing the opportunity to reduce treatment time.

In one embodiment, the rotor is formed from a solid block of material, the roof and the base being constituted by upper and lower regions of the block respectively, an intermediate region of the block having bores therein which define the passages, each divider being defined by the intermediate region between each bore.

In said embodiment, each bore may be of uniform diameter or tapered (inwardly or outwardly). Preferably said bores are of uniform diameter.

In a second embodiment, the dividers are in the form of vanes and each passage is a compartment defined between adjacent vanes.

Preferably, each second outlet is a cut-out extending inwardly from the outer periphery of the roof. Conveniently, the cut-outs are part-circular or semi-circular and are preferably arranged symmetrically around the rotor. It will of course be appreciated that the cut-outs can be of any shape and that one or more of the second outlets could alternatively be constituted by a bore (of any shape) through the roof into one of the compartments.

In all cases, it is preferable that the second outlets do not extend downwardly as far as the base of the rotor.

In a preferred embodiment, the rotor has four passages or compartments (defined by four dividers or vanes) with eight second outlets in the form of semi-circular cut-outs arranged symmetrically around the rotor (i.e. two per compartment). However, the number of outlets may be increased (e.g. to 12 or 16) for larger rotors and reduced for smaller rotors.

Preferably, the rotor is provided with a chamber in which mixing of molten metal and gas can take place. Preferably, the chamber is located radially inwardly of the inlets, preferably has an opening in the base of the rotor and is in the flowpath between the shaft and the inlets, such that in use when the device rotates, molten metal is drawn into the chamber through the base of the rotor where it is mixed with gas passing into the chamber from the shaft, the metal/gas dispersion then being pumped into the passages or the compartments through the inlets before being discharged from the rotor through the first and second outlets.

Preferably, the first outlets have a greater cross-sectional area than the inlets.

Preferably the rotor is circular in transverse cross section and is most preferably attached to the shaft at its centre, so as to reduce drag during rotation.

Preferably, the shaft and rotor are formed separately, the two being attached together by releasable fixing means. The shaft may be connected directly to the rotor (e.g. by providing mating screw threads on each of the shaft and rotor), or indirectly, e.g. via a threaded tubular connection piece.

The rotor is conveniently formed from a solid block of material (preferably graphite), the compartments being conveniently formed by a milling operation.

For the avoidance of doubt, it should be made clear that the invention resides also in the rotor per se.

The present invention further resides in a method of treating molten metal comprising the steps of:—

(i) immersing the rotor and part of the shaft of the device of the present invention in the molten metal to be treated, (ii) rotating the shaft, and (iii) passing gas and optionally one or more treatment substances down the shaft and into the molten metal via the rotor, whereby to degas the metal.

The nature of the molten metal is not restricted. However, preferred metals for the treatment include aluminium and all its alloys (including low silicon alloys (4-6% Si) e.g. BS alloy LM4 (Al—Si5Cu3); medium silicon alloys (7.5-9.5% Si) e.g. BS alloy LM25 (Al—Si7Mg); eutectic alloys (10-13% Si) e.g. BS alloy LM6 (Al—Si12); hypereutectic alloys (>16% Si) e.g. BS alloy LM30 (Al—Si17Cu4Mg); aluminium magnesium alloys e.g. BS alloy LM5 (Al—Mg5Si1; Al—Mg6)), magnesium and its alloys (e.g. BS alloy AZ91 (8.0-9.5% Al) and BS alloy AZ81 (7.5-9.0% Al)) and copper and its alloys (including high conductivity coppers, brasses, tin bronzes, phosphor bronzes, lead bronzes, gunmetals, aluminium bronzes and copper-nickels).

Preferably, the gas is an inert gas (such as argon or nitrogen) and is more preferably dry. Gases not traditionally regarded as being inert but having no deleterious effect on the metal may also be used such as chlorine, or a chlorinated hydrocarbon. The gas may be a mixture of two or more of the foregoing gases. From a balance between cost and inertness of the gas, dry nitrogen is preferred. The method is particularly useful for the removal of hydrogen gas from molten aluminium.

It will be understood that for any given rotor, efficiency of degassing will be determined, inter alia, by the speed of rotation, the gas flow rate and treatment time. A preferred rotation speed is 550 rpm or less and more preferably 400 rpm or less, most preferably about 350 rpm. It will also be understood that for any given rotor, the size and geometry of the holding vessel containing the molten metal will influence the optimum or preferred rotor speed.

As well as degassing, the treatment may also be combined with the injection of fluxes into the melt along with the inert purge gas. The treatment is then a combined degassing/grain refinement and/or modification and/or cleaning/drossing treatment, in which case the optional treatment substance may be granulated cleaning/drossing, grain refining, modification species or a combination of these (usually referred to as "flux" or "fluxes"). Such fluxes may be titanium and/or boron salts (e.g. AlTiB alloy) for grain refining, and sodium salts or strontium (usually as 5-10% master alloy) for modification of aluminium-silicon alloys. Such processes are per se well known to the skilled foundryman.

The required size of the rotor, speed of rotation, gas flow rate and (optional) flux quantity will all be determined by the particular treatment being undertaken, taking into account the mass of metal being treated, the size and geometry of the holding vessel for the molten metal, the optimum treatment time and whether the process is a continuous or a batch process.

An embodiment of the invention will now be described by way of example only, with reference to the accompanying drawings in which:—

Figure 1C:
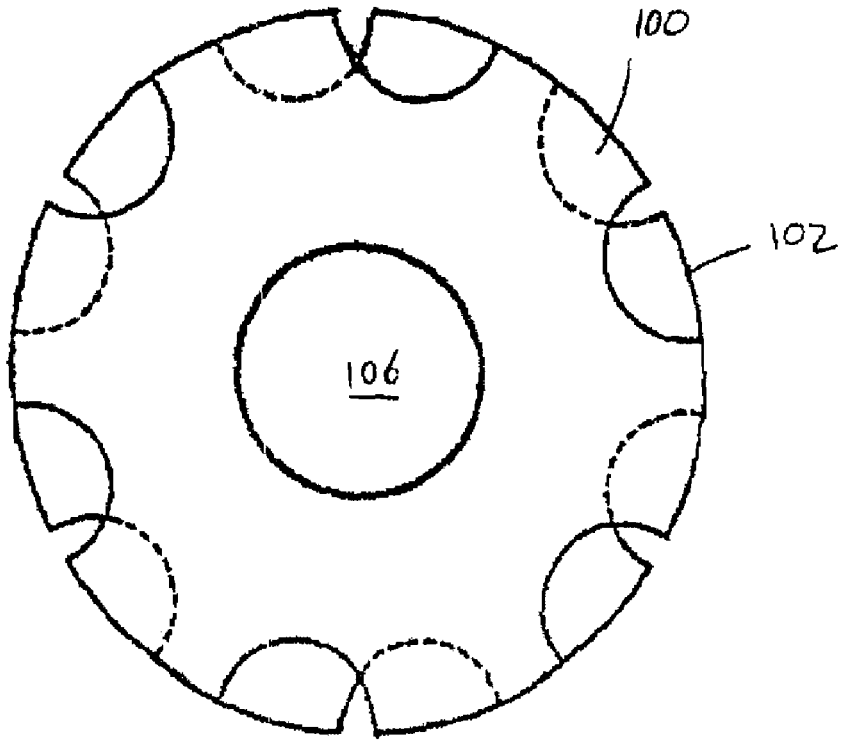
Figure 1c (Prior art)
Figure 2A:
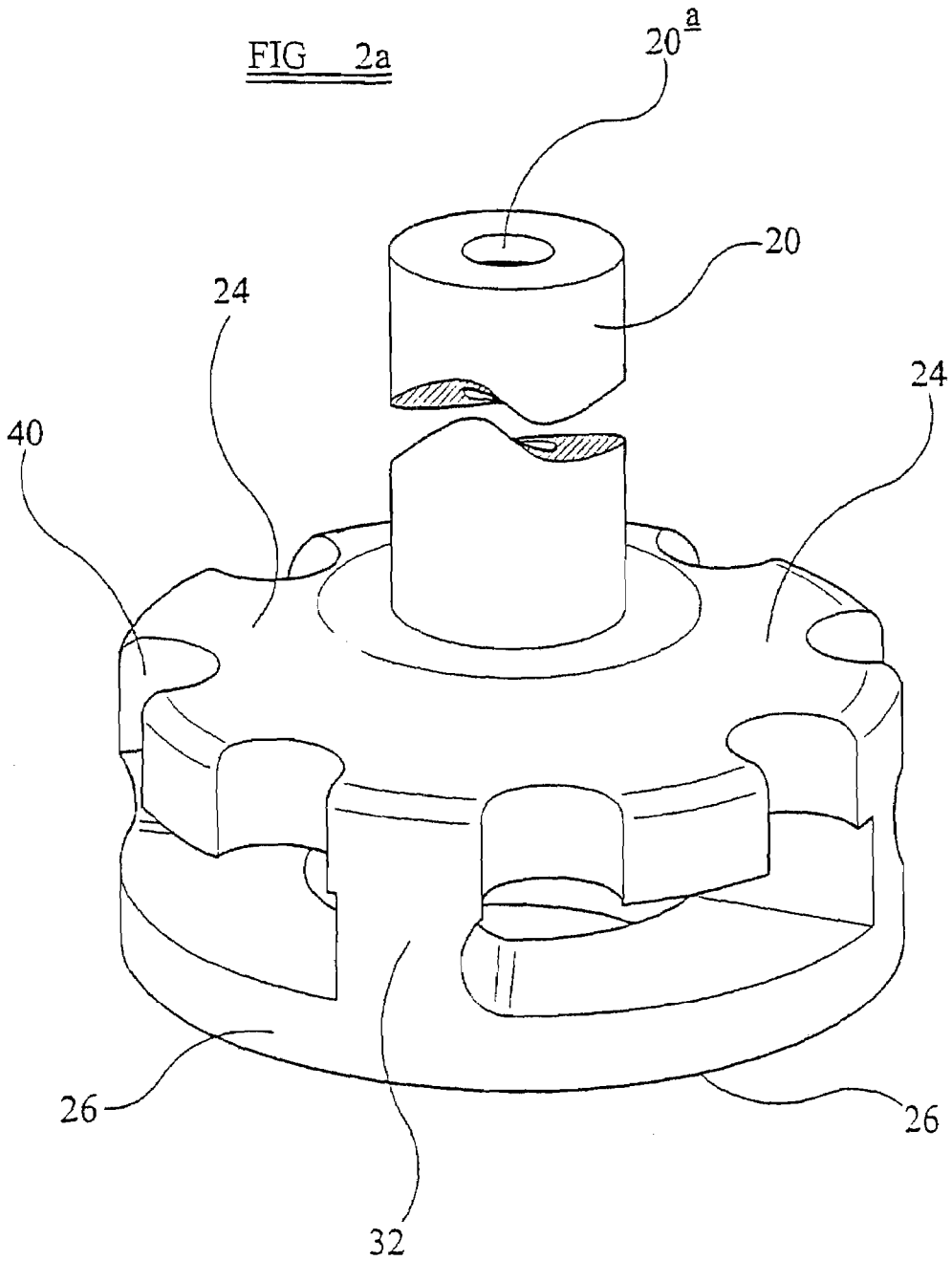
Figure 2B:
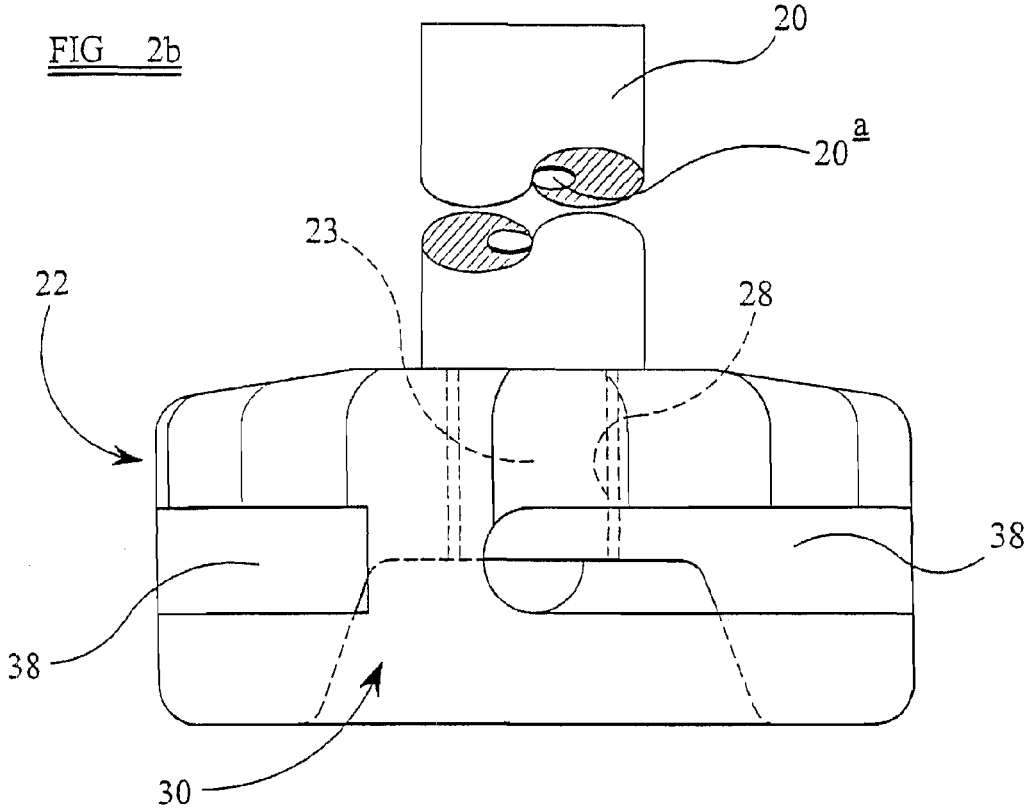
Figure 3:
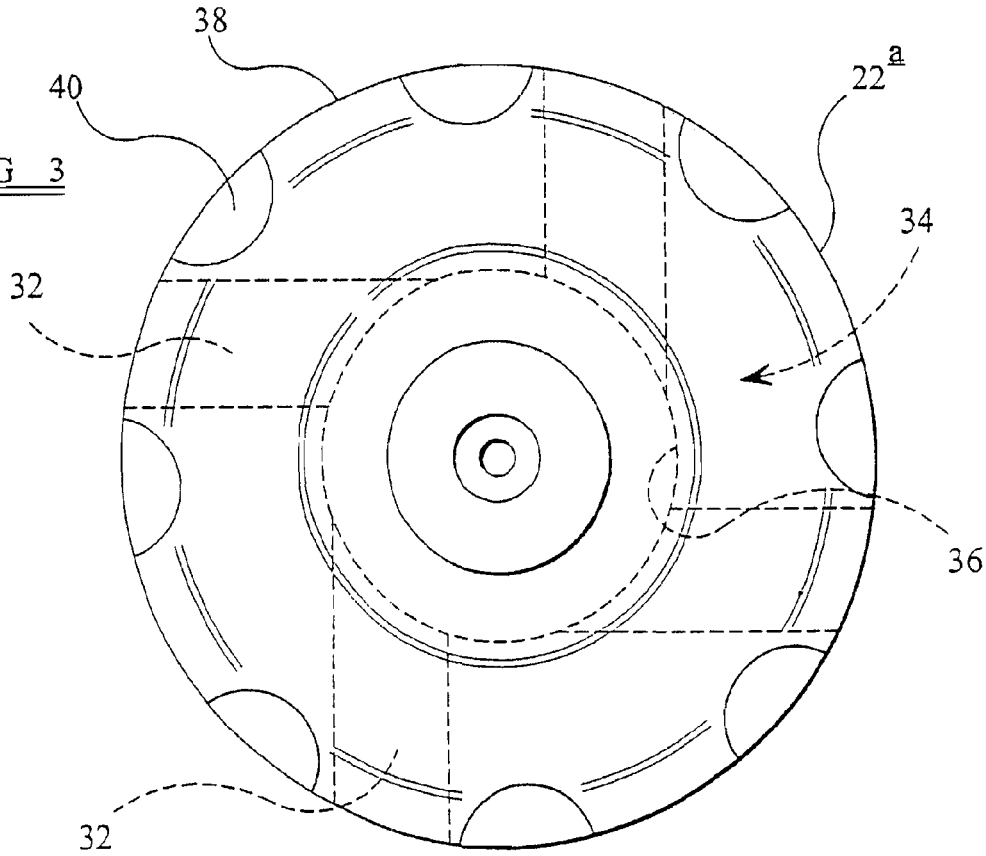
Figure 7:
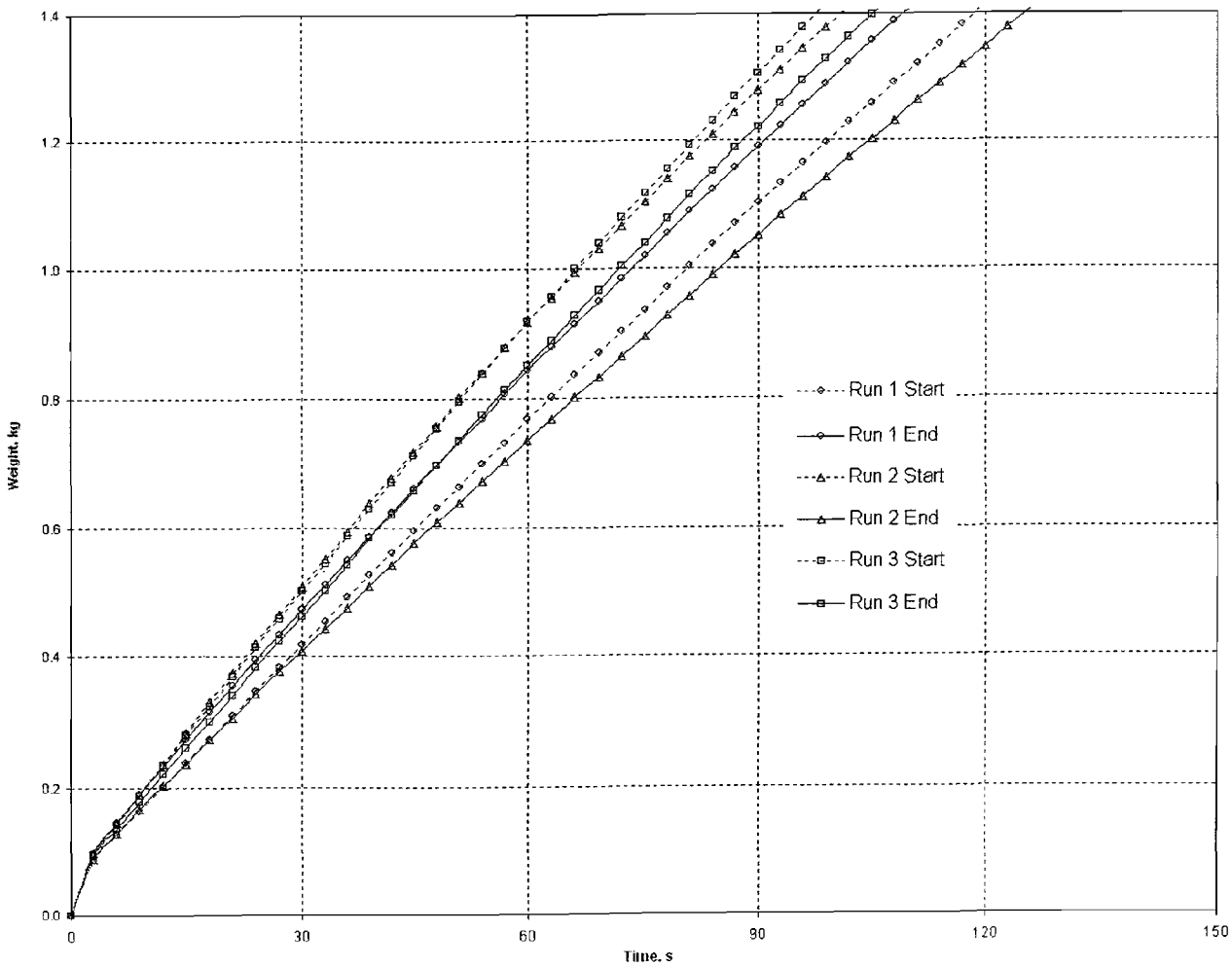
Figure 8:
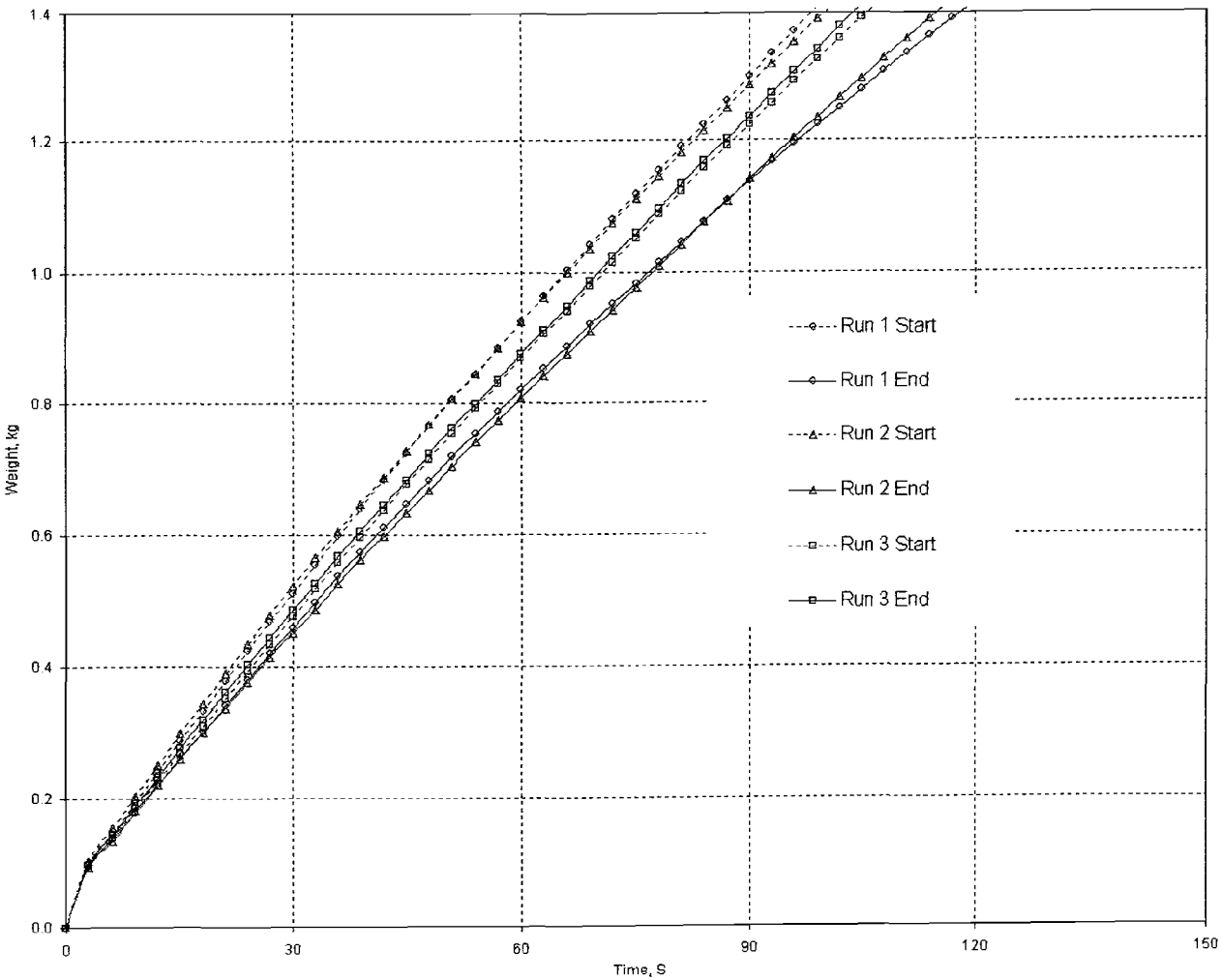
Figure 9:
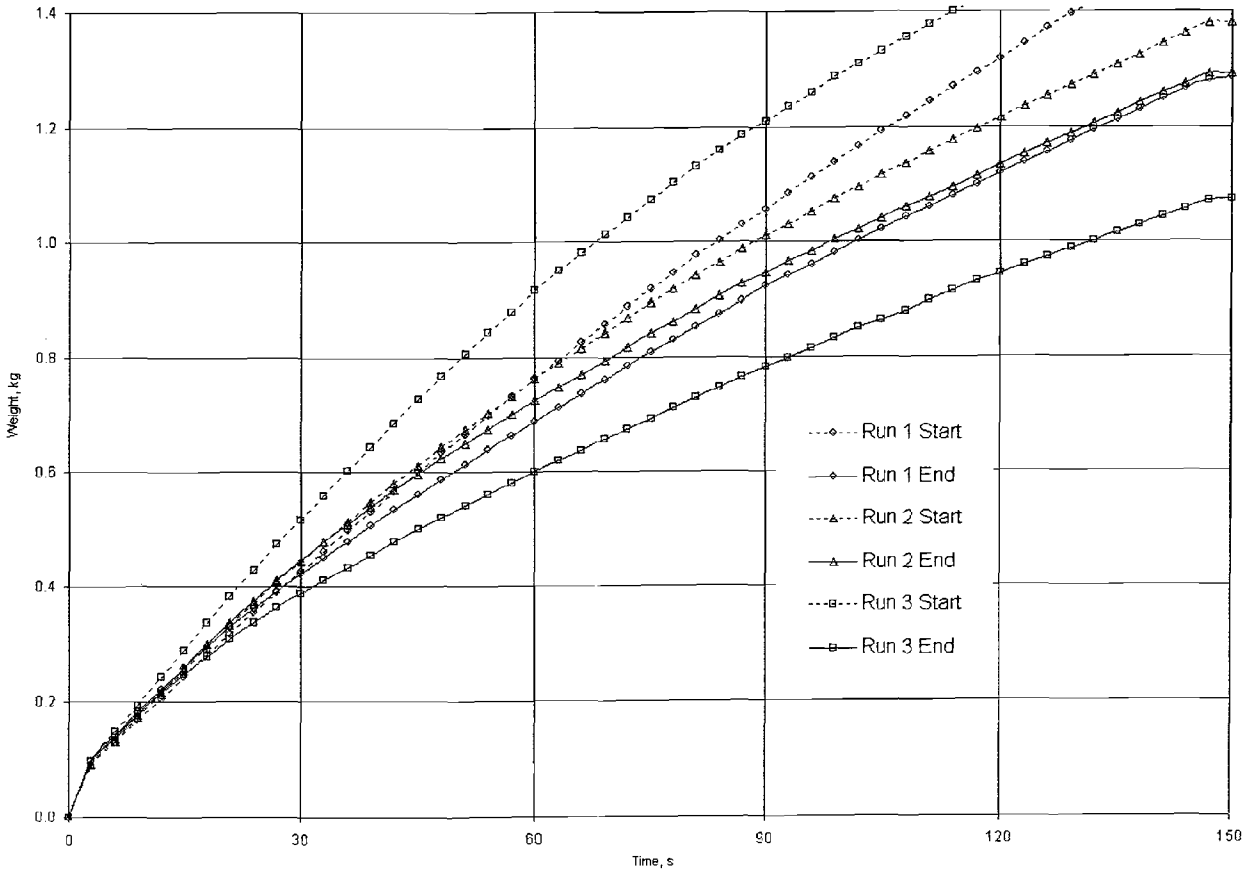

FIG. 1*a* is a vertical section through a prior art rotary device described in EP0332292, FIGS. 1*b* and 1*c* are plan and side views respectively of another prior art rotor, FIGS. 2*a* and 2*b* are respectively a perspective and a side view of a rotary device in accordance with the present invention, FIG. 3 is a top plan view of the rotary device of FIGS. 2*a* and 2*b*, FIGS. 4 to 6 are graphs illustrating reduction in gas content of AlSi10Mg before and after degassing with nitrogen using a rotary device according to the present invention and a comparative rotary device, and FIGS. 7 to 9 are Prefil test curves for a rotary device in accordance with the present invention and two comparative rotary devices respectively Referring to FIGS. 2 and 3, a rotary device for dispersing gas and/or other treatment substances in molten metal is shown. The device comprises a shaft 20 having a bore 20*a* therethrough, a rotor 22 and a tubular connection piece 23.

The rotor 22 is made from graphite and is of unitary construction. The rotor 22 is generally disc-shaped and comprises an annular upper part (roof 24) and spaced therefrom an annular lower part (base 26). A threaded throughbore 28 is provided centrally in the roof 24 of the rotor 22 and serves in use as an attachment point for the tubular connection piece 23 which is correspondingly externally screw-threaded. An open chamber 30 is provided centrally in the base 26 of the rotor 22. The chamber 30 extends upwardly to the roof 24 of the rotor 22 and is continuous with the throughbore 28 in the roof 24, the throughbore 28 and chamber 30 thereby defining a continuous passage vertically through the rotor 22. The chamber 30 extends radially outwardly further than the throughbore 28. The roof 24 and base 26 are connected by four vanes 32 which are disposed between the roof 24 and the base 26 and which extend outwardly from the periphery of the chamber 30 to the periphery 22*a* of the rotor 22. A compartment 34 is defined between each pair of adjacent vanes 32, the chamber 30 and the roof 24 and the base 26. Each compartment 34 has an inlet aperture 36 from the chamber 30 and a first outlet on the periphery 22*a* of the rotor 22 in the form of an elongated slot 38. The outlet slot 38 has a greater cross-sectional area than the inlet aperture 36.

As can be seen more readily in FIG. 3, the peripheral edge 22*a* of the roof 24 of the rotor 22 is provided with a plurality (eight in this embodiment) of part-circular cut-outs 40. Each cut-out 40 serves as a second outlet for its respective compartment 34 (in this case two cut-outs 40 are provided per compartment 34).

An appropriately internally screw-threaded region 20*b* is provided at one end of the shaft 20 for securely mounting the shaft 20 onto the connection piece 23. The opposite end of the shaft 20 is connected to the lower end of a hollow drive shaft (not shown) whose upper end is connected to drive means (in this case an electric motor, not shown) and the bore 20*a* of the shaft 20 is connected through the hollow drive shaft to a source of gas (not shown).

From the description above, it will be clear that a continuous flow path exists from the source of gas, through the bore 20*a* of the shaft 20 and the connection piece 23, through the roof 24 of the rotor 22 into the chamber 30, through the inlet apertures 36 into the compartments 34 and out of the rotor 22 through the first and second outlets 38,40.

In use, the rotor and shaft assembly is immersed in the molten metal to be degassed (in for example a refractory lined ladle or other vessel) and rotated at the desired speed by activation of the electric motor. The source of gas is opened and adjusted to the desired flow rate and degassing carried out for a predetermined duration.

During degassing, gas passes down the shaft 20 into the rotor chamber 30, where it is mixed with molten metal which is drawn upwardly into the chamber 30. The gas/metal dispersion flows into the compartments 34 via the inlets 36 and exits the rotor 22 laterally through the first outlets 38 and upwardly through the second outlets 40.

EXAMPLES 1 TO 3

A rotor as described above having a diameter of 190 mm was used to degas 200 Kg of AlSi10Mg alloy held at 720° C. The gas used was dry nitrogen at a flow rate of 15 L/min. The speed of rotation was 450 rpm and degassing was carried out over 5 minutes (Example 1). The effectiveness of the rotor was assessed by determination of the Density Index (DI) of the metal before and after treatment. DI is calculated using the formula $$DI = \frac{Datm - D80mbar}{Datm} \times 100$$

where Datm is the density of a sample of metal which has been allowed to solidify under atmospheric pressure and D80 mbar is the density of a sample which has been allowed to solidify under a vacuum of 80 mbar. The higher the DI of a sample, the greater the hydrogen gas content of the metal.

Examples 2 and 3 were performed as for Example 1, except that the rotation speed used was 350 rpm (Example 2; treatment time 5 minutes, 2 runs, Example 3; treatment time 3 minutes, 2 runs).

COMPARATIVE EXAMPLES 1 TO 3

For comparison, degassing was carried out under identical conditions to the corresponding Example using a rotor identical to that of Example 1, except that the roof of the rotor was not provided with any cut-outs.

Results

Figure 4:
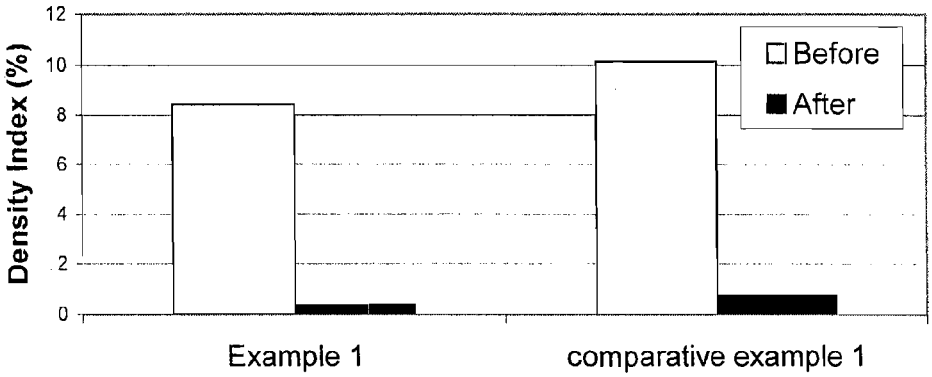
Figure 5:
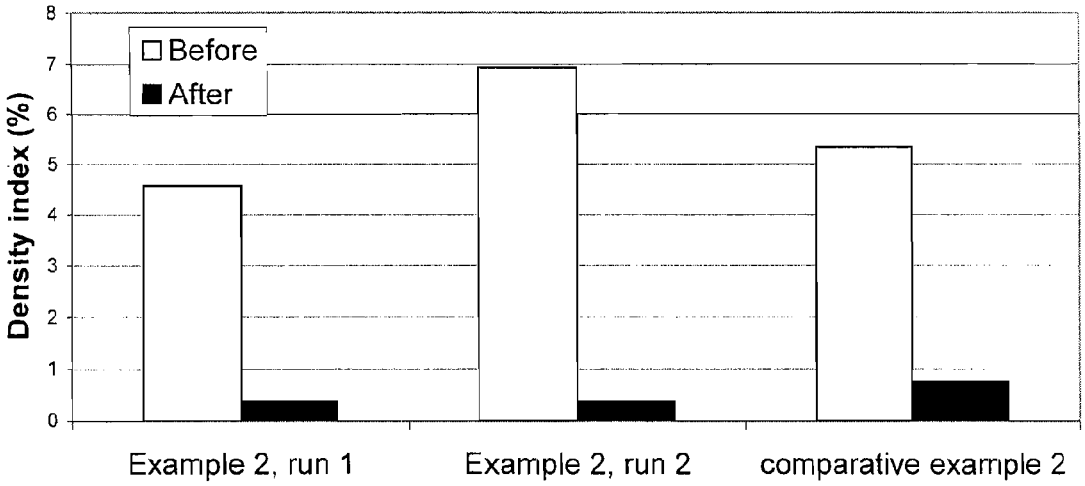
Figure 6:
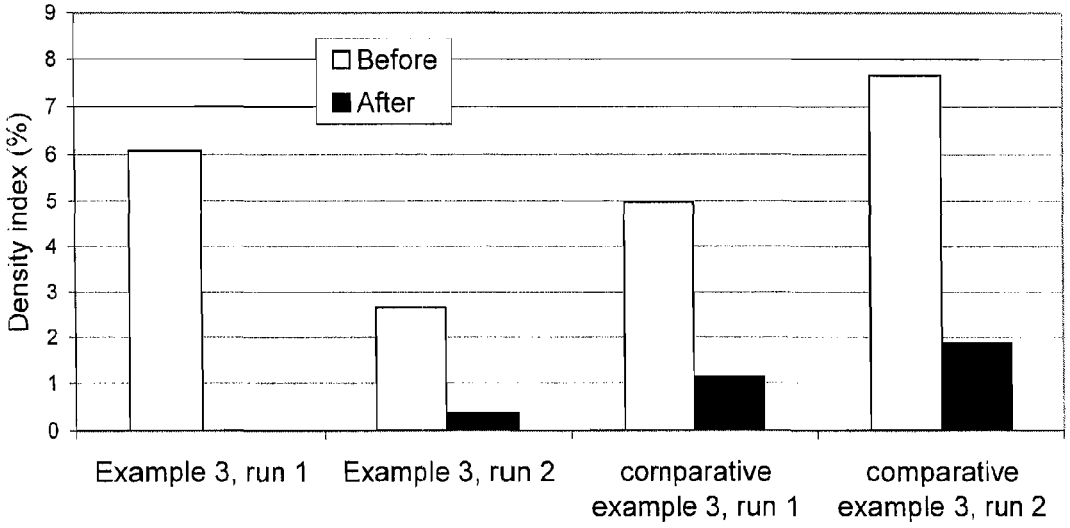

The results in terms of density index (DI) reduction are tabulated below and represented graphically in FIGS. 3 to 5 (Examples/Comparative Examples 1 to 3). Although it will be appreciated that no two batches of melt will have exactly the same starting DI, it is readily apparent that the rotor of the present invention offers a significant improvement over a comparable rotor having the cut-outs omitted. For example, from Table 2 and FIG. 3, it can be seen that the DI of Example 2 (both runs) is half that of comparative Example 2 after treatment, even when the starting DI is higher (run 2).

TABLE 1

| DI (%) (degassing at 450 rpm, 15 L/min for 5 mins) | | |
|---|---|---|
| | Example 1 | Comparative Example 1 |
| Before | 8.43 | 10.15 |
| After | 0.38 | 0.76 |

TABLE 2

| DI (%) (degassing at 350 rpm, 15 L/min for 5 mins) | | | |
|---|---|---|---|
| | Example 2 | | |
| | run 1 | run 2 | Comparative Example 2 |
| Before | 4.58 | 6.92 | 5.34 |
| After | 0.38 | 0.38 | 0.76 |

TABLE 3

| DI (%) (degassing at 350 rpm, 15 L/min for 3 mins) | | | | |
|---|---|---|---|---|
| | Example 3 | | Comparative Example 3 | |
| | run 1 | run 2 | run 1 | run 2 |
| Before | 6.08 | 2.66 | 4.98 | 7.66 |
| After | 0 | 0.38 | 1.15 | 1.89 |

When the degassing time is reduced the efficiency of the comparative rotor deteriorates (comparative example 3), whereas the rotor of the present invention maintains the high reduction in DI (Example 3).

EXAMPLE 4 AND COMPARATIVE EXAMPLES 4 AND 5

A 250 kg melt of LM25 was made in a gas-fired bale out furnace. The charge comprised a mixture of new ingot and process scrap. Each rotor under investigation was mounted in turn on a machine capable of controlling the lance rotation speed and inert gas injection pressure. The rotation speed was set at 350 rpm for Example 4 and Comparative Example 4, and 550 rpm for Comparative Example 5 (manufacturer's recommended rotation speed). Nitrogen was used for the inert gas and the injection pressure was maintained constant throughout the trial.

Three degassing operations were carried out for each rotor. The gas level in the metal was artificially raised at the start of each run by plunging a measured amount of Foseco Hydral™ gassing tablet into the melt. The turbulence created by this operation was also expected to reduce the metal cleanliness by folding in oxides from the surface.

The degassing operation was carried out in 5 minute increments for a total time of 15 minutes for each run. A MK 3VT Vacuum Density Unit (MK GmbH) was used to provide a density index value at the start of the run and at the end of each 5 minute interval. An Alscan™ hydrogen analyser was also used on selected runs to provide a direct measure of hydrogen content. Metal cleanliness was measured at the start and end of each 15 minute period using Prefil.

The Prefil (Pressure Filtration) test gives an on-line quantitative measurement of oxide films and other inclusions. The flow-rate of molten metal through a micro filter at constant temperature and pressure is monitored and used to plot a graph of weight filtered vs time. Inclusions in the metal, such as oxide films, quickly build-up on the filter surface during a test, reducing the flow-rate through the filter. Therefore the slope and overall shape of the weight filtered vs time curve indicates the level of inclusions present in the metal. Oxide films affect the initial slope of the curve (20-30 seconds). They result in straight lines, with a slope that decreases as the number of oxide films increases. Fine particulate inclusions such as $TiB_2$, fine $Al_2O_3$ or carbides cause the curve in the Prefil test to deviate from a straight line. The loading of fine particles can be inferred from the point at which the curve begins to deviate from the initial slope.

In addition to the filtration curve, metallographic analysis of the residue that is retained on the filter after a Prefil test allows identification and quantification of the types of inclusions present in the metal sample to be carried out.

EXAMPLE 4

The rotor was as described above and similar to Example 1 but with a smaller diameter of 140 mm.

COMPARATIVE EXAMPLE 4

The rotor was as used in comparative examples 1 to 3 but with a diameter of 140 mm.

COMPARATIVE EXAMPLE 5

The rotor was as shown in FIG. 1*b* with a diameter of 140 mm.

Results

Density Index

An examination of the DI values in Table 4 indicates that the Example 4 rotor is similar in degassing efficiency to the comparative Example 5 rotor, both rapidly degas the melt in the first 5 minutes of operation with only slight improvement, if any, gained by continuing to degas for a further five minutes. However, the lower operating speed of the Example 4 rotor will have a beneficial effect on rotor/lance life.

The comparative Example 4 rotor is the least efficient degasser. It takes longer to achieve a low density index compared with the other two rotors and the lowest value obtained, 2.5% after 15 minutes, is markedly higher than can be achieved by the other two rotors, <0.75% after 5 minutes.

A reduced pressure test is a simple test using robust equipment for assessing the propensity of a melt to gas porosity. However it does not measure the hydrogen content directly and it is sensitive to variables that are difficult to control; such as differences in sampling methods from operator to operator, changes in metal cleanliness (nuclei for gas precipitation) and even vibration from the shop floor. Alscan gives a direct measure of hydrogen content and is independent of these variables. There was a good correlation between Alscan measured under laboratory conditions and density index (data not shown)

TABLE 4

| | time | Example 4 DI | Comp. Ex 4 DI | Comp. Ex. 5 DI |
|---|---|---|---|---|
| Run 1 | 0 | 9.54 | 23.35 | 12.98 |
| | 5 | 2.26 | 10.65 | 1.51 |
| | 10 | 0.75 | 4.89 | 0.75 |
| | 15 | 0.75 | 3.01 | 0.75 |
| Run 2 | 0 | 8.37 | 11.03 | 5.68 |
| | 5 | 0.76 | 5.66 | 0.38 |
| | 10 | 0.75 | 3.75 | 0.38 |
| | 15 | 0.75 | 2.63 | 1.13 |
| Run 3 | 0 | 6.08 | 14.83 | 4.55 |
| | 5 | 0.75 | 7.92 | 1.14 |
| | 10 | 0.75 | 2.55 | 0.38 |
| | 15 | 0.75 | 2.62 | 0.38 |

Metal Cleanliness

The curves generated for the rotors are shown in FIGS. 7 to 9. The comparative example 5 rotor curve (FIG. 9) shows that the melt metal cleanliness is consistently worse after a 15 minute degassing operation. The deviation from a straight line as the curves turn over is indicative of the filter becoming blocked by oxide films. This is consistent with the observation made during the trial that this rotor caused pronounced turbulence and folding in of the melt surface into the bulk metal.

The curves obtained for Example 4 and comparative Example 4 (FIGS. 7 and 8 respectively) are grouped more closely together. In some instances metal cleanliness was improved as a result of degassing, in others it was made slightly worse. However, it is noticeable that the curves obtained for the two rotors are of steeper gradient than those obtained for comparative Example 5 and that they do not turn-over to the same extent, indicating a lower level of oxide films. The results suggest that the Example 4 (and Comparative Example 4) rotor does not have a significant effect (beneficial or detrimental) on metal cleanliness.

A further trial was undertaken using the Comparative Example 5 rotor at a rotation speed of 350 rpm. The gas bubble pattern changed completely and large bubbles appeared on the surface of the melt, with metal being thrown from the furnace into the general casting area. The trial was abandoned for safety reasons.

The invention claimed is:

1. A rotary device for dispersing a gas in a molten metal, said device comprising a hollow shaft at one end of which is a rotor, said rotor having a roof and a base, said roof and base being spaced apart and connected by a plurality of dividers, a passage being defined between each adjacent pair of dividers and the roof and the base, each passage having an inlet and first and second outlets, a flow path being defined through the shaft into the inlets of the passages and out of the first and second outlets, wherein each first outlet is disposed radially outwardly of the respective inlet and arranged to disperse gas laterally of the rotor in use, and wherein each second outlet is disposed in the roof of the rotor and arranged to disperse gas upwardly from the rotor in use.

2. A device as claimed in claim 1, wherein the rotor is formed from a solid block of material, the roof and the base being constituted by upper and lower regions of the block respectively, an intermediate region of the block having bores therein which define the passages, each divider being defined by the intermediate region between each bore.

3. A device as claimed in claim 2, wherein each bore is of uniform diameter.

4. A device as claimed in claim 1, wherein the dividers are in the form of vanes and each passage is a compartment defined between adjacent vanes.

5. A device as claimed in claim 1, wherein each second outlet is a cut-out extending inwardly from the outer periphery of the roof.

6. A device as claimed in claim 5, wherein the cut-outs are part-circular or semi-circular.

7. A device as claimed in claim 1, wherein the second outlets do not extend downwardly as far as the base of the rotor.

8. A device as claimed in claim 1, wherein the rotor has four passages defined by four dividers with eight second outlets in the form of semi-circular cut-outs arranged symmetrically around the rotor.

9. A device as claimed in claim 1, wherein the rotor is provided with a chamber in which mixing of molten metal and gas can take place.

10. A device as claimed in claim 9, wherein the chamber is located radially inwardly of the inlets and has an opening in the base of the rotor, such that in use when the device rotates, molten metal is drawn into the chamber through the base of the rotor where it is mixed with gas passing into the chamber from the shaft, the metal/gas dispersion then being pumped into the passages through the inlets before being discharged from the rotor through the first and second outlets.

11. A device as claimed in claim 1, wherein the first outlets have a greater cross-sectional area than the inlets.

12. A device as claimed in claim 1, wherein the rotor is circular in transverse cross section.

13. A device as claimed in claim 1, wherein the shaft and rotor are formed separately, the two being attached together by releasable fixing means.

14. A device as claimed in claim 1, wherein the rotor is formed from a solid block of graphite.

15. A method of treating molten metal comprising the steps of:

(i) immersing the rotor and part of the shaft of the device of claim 1 in the molten metal to be treated, (ii) rotating the shaft, and (iii) passing gas and optionally one or more treatment substances down the shaft and into the molten metal via the rotor, whereby to degas the metal.

16. The method as claimed in claim 15, wherein the metal to be treated is selected from aluminum, magnesium, copper and alloys thereof.

17. The method as claimed in claim 15, wherein the gas used in step (iii) is selected from one or more of chlorine, a chlorinated hydrocarbon, nitrogen and argon.

18. The method as claimed in claim 17, wherein the gas used in step (iii) is dry nitrogen.

19. The method as claimed in claim 15, wherein the treatment of molten metal comprises a grain refinement and/or modification and/or cleaning treatment and the optional treatment substance of step (iii) is a granulated cleaning/drossing, grain refining and/or modification species.

20. The method as claimed in claim 19, wherein the optional treatment substance is selected from one or more of titanium salts and/or boron salts, sodium salts and strontium master alloy.

21. The method as claimed in claim 15, wherein the rotation speed of step (ii) is 400 rpm or less.

22. A rotor for use in the rotary device of claim 1, said rotor comprising a roof and a base, said roof and base being spaced apart and connected by a plurality of dividers, a passage being defined between each adjacent pair of dividers and the roof and the base, each passage having a gas inlet and first and second gas outlets, wherein each first outlet is disposed radially outwardly of the respective inlet and arranged to disperse gas laterally of the rotor in use, and wherein each second outlet is disposed in the roof of the rotor and arranged to disperse gas upwardly from the rotor in use.

23. A device as claimed in claim 6, wherein the cut-outs are arranged symmetrically around the rotor.

24. A device as claimed in claim 12, wherein the rotor is attached to the shaft at its centre.

* * * * *